United States Patent [19]

Sugimoto et al.

[11] Patent Number: 4,665,012

[45] Date of Patent: May 12, 1987

[54] SILVER HALIDE PHOTOGRAPHIC LIGHT-SENSITIVE MATERIAL

[75] Inventors: Tadao Sugimoto; Sumito Yamada, both of Kanagawa, Japan

[73] Assignee: Fuji Photo Film Co., Ltd., Kanagawa, Japan

[21] Appl. No.: 774,864

[22] Filed: Sep. 11, 1985

Related U.S. Application Data

[63] Continuation of Ser. No. 556,216, Nov. 29, 1983, abandoned.

[30] Foreign Application Priority Data

Nov. 29, 1982 [JP] Japan ..... 57-209002

[51] Int. Cl.[4] ..... G03C 1/02

[52] U.S. Cl. ..... 430/502; 430/569; 430/567

[58] Field of Search ..... 430/567, 569, 502

[56] References Cited

U.S. PATENT DOCUMENTS

| | | | |
|---|---|---|---|
| 4,150,994 | 4/1979 | Maternaghan | 430/569 |
| 4,210,450 | 7/1980 | Corben | 430/567 |
| 4,414,306 | 11/1983 | Wey et al. | 430/569 |
| 4,414,310 | 11/1983 | Daubendiek et al. | 430/567 |
| 4,433,048 | 2/1984 | Solberg et al. | 430/569 |
| 4,434,226 | 2/1984 | Wilgus et al. | 430/569 |
| 4,459,353 | 7/1984 | Maskasky | 430/434 |
| 4,477,564 | 10/1984 | Cellone et al. | 430/567 |
| 4,504,570 | 3/1985 | Evans et al. | 430/567 |

*Primary Examiner*—Won H. Louie

*Attorney, Agent, or Firm*—Sughrue, Mion, Zinn, Macpeak, and Seas

[57] ABSTRACT

A silver halide photographic light-sensitive material is disclosed. The material is comprised of a support having thereon a silver halide emulsion layer containing light-sensitive silver halide grains, at least 10% (in number) of said halide grains being tabular grains having a diameter/thickness ratio of not less than 5. The tabular grains include an iodine-containing silver halide solid solution in an interior portion thereof which is contained in areas covering, with regard to its major or minor axis direction, 80% by mole of the silver contained in the grain. Further, the tabular grains have an average iodine content in the internal high iodine phase which is five times that of the silver bromide, iodobromide or chloroiodobromide contained in the phase present outside of the internal high iodide phase. In addition, the silver contained in the internal high iodine phase is not more than 50% by mole of the total amount of silver in the tabular grains. The photographic material has the advantages inherent to the use of tabular grains and has improved pressure resistant characteristics.

22 Claims, 1 Drawing Figure

SILVER HALIDE PHOTOGRAPHIC LIGHT-SENSITIVE MATERIAL

This is a continuation of application Ser. No. 556,216 filed Nov. 29, 1983 now abandoned.

FIELD OF THE INVENTION

The present invention relates to a silver halide photographic light-sensitive material and, more particularly, to a photographic light-sensitive material comprising a light-sensitive silver halide emulsion layer containing tabular silver halide grains.

BACKGROUND OF THE INVENTION

In general, photographic light-sensitive materials coated thereon with silver halide emulsions are subjected to various pressures. For example, ordinary negative films are bent when being charged into cartridges or cameras, or are pulled when being forwarded by each frame in a camera.

Sheet films, such as lithographic and medical X-ray films, are often bent or folded when handled directly with human hands.

In addition, every light-sensitive material is subjected to heavy pressures upon cutting and processing thereof.

When a light-sensitive material is subjected to pressures as mentioned above, silver halide grains contained therein are also subjected to pressures via gelatin (or vehicle or binder) or via a plastic film (or support). It is known that silver halide photographic light-sensitive materials experience changes in their photographic properties when silver halide grains contained therein are exposed to pressures, as reported in detail by K. B. Mather, *J. Opt. Soc. Am.*, 38, 1054 (1948), P. Faelens and P. de Smet, *Sci. et Ind. Photo.*, 25, No. 5, 178 (1954), P. Faelens, *J. Phot. Sci.*, 2, 105 (1954), etc.

It has, therefore, been strongly desired to provide a photographic light-sensitive material which can be free from such changes in photographic properties caused by pressure.

In known methods to improve pressure characteristics of silver halide photographic light-sensitive materials, silver halide emulsions having a relatively small silver halide/gelatin ratio are employed, or a plasticizer, such as polymers and emulsions, is incorporated therein, so that pressures imposed thereon would not reach to silver halide grains. Examples of plasticizers so far proposed include heterocyclic compounds described in British Patent No. 738,618; alkylphthalates described in British Patent No. 738,637; alkylesters described in British Patent No. 738,639; polyhydric alcohols described in U.S. Pat. No. 2,960,404; carboxyalkyl celluloses described in U.S. Pat. No. 3,121,060; paraffins and salts of carboxylic acids described in Japanese Patent Application (OPI) No. 5017/74 (the term "OPI" as used herein refers to a "published unexamined Japanese patent application"); and alkyl acrylates and organic acids described in Japanese Patent Publication No. 28086/78.

However, adequate effects could hardly be attainable by this means since plasticizers can be used only in limited amounts as the incorporation of plasticizers decreases mechanical strengths of emulsion layers, and the use of an increased amount of gelatin makes processing treatment slower.

In spite of the above facts, the means can be fairly effective and almost satisfactory pressure characteristics can be attained in the case of silver halide photographic light-sensitive materials employing emulsion layers containing spherical silver halide grains, i.e., hexahedral, octahedral or potato-shaped grains, which are less susceptible to distortions caused by external forces than flat grains having a large diameter/thickness ratio.

In general, tabular silver halide grains having a large diameter/thickness ratio are capable of forming high optical densities with smaller amounts of silver since they have a large covering area per unit when coated on a support. In addition, such silver halide grains also possess high abilities to capture incidented light, as well as excellent spectral sensitization properties. However, satisfactory pressure characteristics could hardly be obtained by the above-described means when tabular grains are employed since they are extremely susceptible to external forces due to their shapes.

For example, tabular silver halide grains formed by adding silver nitrate to a solution containing gelatin and potassium bromide and potassium iodide give a photographic emulsion which shows a considerable lowering in sensitivity when exposed to pressure. This sort of desensitization caused by pressure can be reduced by the use of pure silver bromide grains, or silver iodobromide grains having a completely uniform halogen composition throughout the grain which are produced by simultaneously adding both silver nitrate and halide solutions by the double jet method, without regeneration of nuclei. Such silver halides, however, are highly subject to fogs caused by pressure and, hence, disadvantageous in practical use.

SUMMARY OF THE INVENTION

It is, therefore, an object of the present invention to provide a photographic light-sensitive material comprising tabular silver halide grains having improved pressure characteristics.

It is another object of the present invention to provide a method for producing silver halide grains having improved pressure characteristics.

These and other objects of the present invention can be achieved by a photographic light-sensitive material comprising a support having thereon at least one silver halide emulsion layer containing light-sensitive silver halide grains, at least 10% (in number) of said silver halide grains being flat grains having a diameter/thickness ratio of not less than 5, and said flat silver halide grains satisfying the following conditions:

(1) Each tabular grain comprises an iodine-containing silver halide solid solution (internal high iodine phase) in the interior part thereof, and said internal high iodine phase is contained within an area covering, with regard to its major or minor axis direction, 80% by mole of silver contained in the grain;

(2) The average iodine content in said internal high iodine phase is at least 5 times that of silver bromide, iodobromide or chloroiodobromide contained in the phase which presents outside of said phase; and (3) The amount of silver contained in said internal high iodine phase is not more than 50% by mole of the total amount of silver contained in the grain.

DETAILED DESCRIPTION OF THE INVENTION

Figure 1:
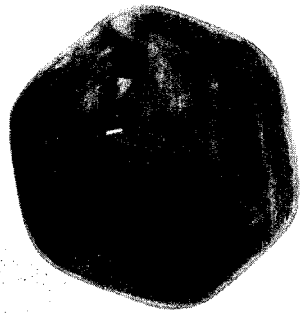
FIG. 1 shows a photograph of a tabular grain in Sample IV-1 according to the present invention, magnified by a factor of 40,000 by a high voltage electron microscope of transmission type.

The tabular silver halide grains (hereinafter referred to as "tabular grains") preferably have a diameter/-thickness ratio of 5 to 100, more preferably from 5 to 50, most preferably from 7 to 20.

The term "diameter of a tabular grain" as used herein means the diameter of a circle having an area equal to the projected area of the grain.

The diameter of tabular grains according to the present invention can be from 0.5 to 10 μm, preferably from 0.5 to 5.0 μm, more preferably from 1.0 to 4.0 μm.

In general, a tabular grain has two parallel planes and, therefore, the term "thickness" herein means the distance between the two parallel planes.

Preferably, the tabular grains consist of silver iodobromide or chloroiodobromide. Silver iodobromides having a silver iodide content of from 0.1 to 10% by mole can be particularly advantageous.

Processes for producing tabular grains are known in the art and can be employed for the production of tabular grains according to the present invention.

For example, silver halides may be precipitated under a relatively high pAg condition, e.g., at a pBr not less than 1.3, to form seed crystals comprising not less than 40% (by weight) of tabular particles, which may then be allowed to grow by simultaneously adding silver and halide solutions at around the same pBr to obtain desired tabular grains. Preferably, the silver halide solutions are added under such a condition that no crystal nuclei would be formed during the growth of tabular grains.

The size of tabular grains may be adjusted through control of temperature, kind and amount of solvents used, rate of addition of silver salts or halides used during the growth of tabular grains, or the like.

Detailed descriptions will hereinafter be made on conditions (1), (2) and (3) which the tabular grains according to the present invention must satisfy.

By "internal high iodine phase" is herein meant an iodine-containing silver halide solid solution.

Preferably, the internal high iodine phase is composed of silver iodide, silver iodobromide or silver chloroiodobromide. Silver iodides or iodobromides (preferably those having an iodine content of 0.5 to 40% by mole) can be particularly advantageous. The silver halide solid solution or internal high iodine phase preferably has a uniform halogen composition throughout the phase. By the term "uniform" is herein meant that iodine is distributed in the phase with a coefficient of variation not more than 40%, preferably not more than 20% above or below average iodine content.

The internal high iodine phase must be present in the interior of the tabular grain. It is required that the phase be positioned inside of an area covering, with regard to its major or minor axis direction, 80% by mole of silver contained in the grain.

In the case where said phase has a relatively high iodine content and, at the same time, a relatively high fraction (e.g., 10 to 40% of the total grain), the phase is preferably present at positions further from the center of the grain. On the contrary, when the phase has a relatively low iodine content and a relatively low molecular fraction (e.g., less than 10% by mole), it is preferably present at positions nearer to the center of the grain.

In particular, it is preferred that the internal high iodine phase be positioned inside of an area covering, with regard to the major axis direction of the tabular grains, 80% by mole, preferably 60% by mole, of silver contained in the grain.

In this specification, the term "major axis direction" means the direction along the diameter of the tabular grain, and the term "minor axis direction" means the direction along its thickness.

The average iodine content in said internal high iodine phase is not less than 5 times, preferably not less than 10 times, more preferably not less than 20 times, that of silver iodide, silver iodobromide or silver chloroiodobromide positioned outside of said phase.

Preferably, the silver halides positioned outside of said internal high iodine phase also form a uniform phase.

The amount of silver contained in said internal high iodine phase is not more than 50%, preferably not more than 40%, by mole, based on the total amount of silver contained in the grain.

The internal high iodine phase may be present in the central part of a tabular grain. Alternatively, a tabular grain may have a central part consisting of silver bromide or silver iodobromide having a relatively low iodine content, and an annular internal high iodine phase which encircles said central part. In both cases, the internal high iodine phase is covered with a phase of silver bromide, silver iodobromide having a low iodine content, or silver chloroiodobromide having a low iodine content.

Typical procedures for producing tabular grains incorporated with an internal high iodine phase according to the present invention are described below.

Procedure 1

An aqueous solution of potassium bromide and potassium iodide (aqueous halide solution) and an aqueous silver nitrate solution (aqueous silver solution) are simultaneously added to a vessel to form silver iodobromide (internal high iodine phase), in accordance with the double jet method. Subsequently, an aqueous silver solution is added thereto concurrently with an aqueous potassium bromide solution or an aqueous solution of potassium bromide and potassium iodide by double jet method to cover the silver iodobromide (internal high iodine phase) with a uniform phase of silver bromide or silver iodobromide having a low iodine content.

In this procedure, the conditions (1), (2) and (3) which the tabular grains according to the present invention must satisfy can be readily met by adjusting the amount of silver and halogen added in the first and second steps.

Procedure 2

Into a reaction vessel are placed an aqueous potassium bromide solution and an aqueous silver solution to form silver bromide.

Subsequently, a silver solution is added thereto concurrently with an aqueous potassium bromide solution or an aqueous solution containing both potassium bromide and iodide by double jet method. In the course of the addition step, an aqueous solution of potassium iodide is additionally added thereto (triple jet method), thereby forming an internal high iodine phase. It is a matter of course that even after the completion of addition of the aqueous potassium solution by the triple jet method, the addition of the aqueous silver solution and the aqueous potassium bromide solution or the aqueous solution of potassium bromide and iodide is contihued by the double jet method to form a uniform phase consisting of silver bromide or silver iodobromide having a low iodine content, at positions encircling the internal high iodine phase.

The timing and other conditions to form the internal high iodine phase can be selected arbitrarily so long as said conditions (1), (2) and (3) are met.

Procedure 3

Silver bromide is formed in the same manner as in Procedure 2 described above. An aqueous silver solution and an aqueous solution of potassium bromide and iodide are simultaneously added thereto by the double jet method, whereby the silver bromide is covered with silver iodide (internal high iodine phase).

Subsequently, an aqueous silver solution and an aqueous potassium bromide solution are added simultaneously by the double jet method to form a uniform phase of silver bromide around the internal high iodine phase.

Procedure 4 Conversion Method

Silver bromide is formed in the same manner as in Procedure 2 described above. An aqueous potassium iodide solution is then added thereto to form silver iodobromide on the surface of silver bromide by means of conversion, thus forming an internal high iodine phase.

Thereafter, an aqueous silver solution is added thereto concurrently with an aqueous potassium bromide solution or an aqueous solution of potassium bromide and potassium iodide by the double jet method to form a uniform phase of silver bromide or silver iodobromide having a low iodine content around the internal high iodine phase formed by conversion.

Procedure 5

To a reaction vessel containing potassium iodide and potassium bromide are added an aqueous silver solution and an aqueous potassium bromide solution by the double jet method to form an internal high iodine phase consisting of silver iodobromide. Subsequently, an aqueous silver solution is added thereto concurrently with an aqueous potassium bromide solution or an aqueous solution of potassium bromide and potassium iodide by means of the double jet method, thereby covering the internal high iodine phase with a uniform phase of silver bromide or silver iodobromide having a relatively low silver content.

It would be needless to say that tabular grains incorporated with an internal high iodine phase may also be produced according to a procedure not described above and that various modifications can be made to the procedures described above.

For instance, the silver bromide or silver iodobromide having a low iodine content which lies inside of an internal high iodine phase can be formed by either the double jet method or single jet method. Silver halides contained in tabular grains may comprise silver chloride. In addition, the steps for forming silver halides by the double jet method may not be conducted at one stage, in other words, may be divided into a plurality of stages.

Upon the production of tabular grains according to the present invention, there may be used a silver halide solvent, so as to control the size and shape of grains (e.g., diameter/thickness ratio), the grain size distribution and the growth rate of grains. Such a solvent is preferably used in an amount of from 0.001 to 1.0% by weight, in particular, from 0.01 to 0.1% by weight, based on the weight of reaction mixture. In general, when a silver halide solvent is used in a relatively large amount, monodispersed grains are formed with an increased grain growth rate. The thickness of the grains tends to be increased by increasing the amount of silver halide solvent used.

As examples of frequently used silver halide solvents, mention may be made of ammonia, thioethers and thioureas. As to thioethers, reference may be made to U.S. Pat. Nos. 3,271,157; 3,790,387 and 3,574,628.

Upon the precipitation of tabular grains according to the present invention, both the amount and concentration of silver salt solutions (e.g., aqueous $AgNO_3$ solution) and halide solutions (e.g., aqueous KBr solution) to be used therefor may be increased gradually, so as to increase the growth of grains formed therefrom. As to this technique, reference may be made to British Patent No. 1,335,925, U.S. Pat. Nos. 3,672,900, 3,650,757 and 4,242,445, Japanese Patent Application (OPI) Nos. 142329/80 and 158124/80, and the like.

The tabular grains according to the present invention can be chemically sensitized in accordance with conventional methods, including sulfur sensitization, reduction sensitization and noble metal sensitization methods. Examples of usable sulfur sensitizers include thiosulfates, thioureas, thiazoles, rhodanines, active gelatins, and the like. Specific examples of sulfur sensitizers are described in U.S. Pat. Nos. 1,574,944, 2,410,689, 2,278,947, 2,728,668, 3,656,955, 4,032,928 and 4,067,740. Examples of useful reduction sensitizers include stannous salts, amines, hydrazines, formamidinesulfinic acids, silanes, and the like. Specific examples of such compounds are described in U.S. Pat. Nos. 2,487,850, 2,419,974, 2,518,698, 2,983,609, 2,983,610, 2,694,637, 3,930,867 and 4,054,458. For noble metal sensitization, there may be used not only gold complexes but complexes of group VIII metals, such as platinum, iridium and palladium. Specific examples of useful complexes are described in U.S. Pat. Nos. 2,399,083 and 2,448,060, British Patent No. 618,061, and the like.

Two or more of these chemical sensitization methods can be applied to the tabular grains according to the present invention. From the viewpoint of conservation of silver, the tabular grains according to the present invention may be sensitized with advantage by a gold sensitizer and/or a sulfur sensitizer.

The tabular grains according to the present invention may be used in a light-sensitive layer together with silver halide grains of a different type. In such a case, the tabular grains may be comprised in the layer in an amount not less than 10%, preferably not less than 30% of the total number of silver halide grains contained therein.

The thickness of a light-sensitive layer which contains the tabular grains according to the present invention may be preferably from 0.5 to 5.0 μm, in particular, from 1.0 to 3.0 μm.

The tabular grains may be preferably coated at a coverage (per side of support) of from 0.5 $g/m^2$ to 6.0 $g/m^2$, in particular, from 1.0 to 4.0 $g/m^2$.

Upon a light-sensitive layer containing the tabular grains according to the present invention, there may be another light-sensitive layer containing ordinary silver halide grains with spherical shapes. Such a layer may, of course, be present under a light-sensitive layer containing the tabular grains according to the present invention.

Light-sensitive layers containing the tabular grains may be provided on both sides of a support.

As binders or protective colloids for photographic emulsions according to the present invention, gelatin can be used with advantage. Other hydrophilic colloids, however, can also be used for this purpose. Examples of useful hydrophilic colloids include proteins, such as gelatin derivatives, graft polymers derived from gelatin and other polymers, albumin and casein; cellulose derivatives, such as hydroxyethyl celluloses, carboxymethyl celluloses and cellulose sulfates; saccharose derivatives, such as sodium alginate and starch derivatives; and synthetic hydrophilic polymers, such as polyvinyl alcohols, partial acetals of polyvinyl alcohols, poly-N-vinylpyrrolidones, polyacrylates, polvmethacrylates, polyacrylamides, polyvinylimidazoles and polyvinylpyrazoles.

Examples of usable gelatins include lime-treated gelatins and acid-treated gelatins, as well as gelatins treated with enzymes, such as those described in *Bull. Soc. Sci. Phot. Japan,* 16, 30 (1966). It is also possible to use hydrolyzed gelatins or gelatins decomposed with enzymes. Examples of usable gelatin derivatives include those obtained by reacting gelatin with such compounds as acid halides, acid anhydrides, isocyanates, bromoacetic acids, alkanesulfones, vinylsulfonamides, maleimides, polyalkylene oxides and epoxides.

Photographic emulsions according to the present invention can be incorporated with various compounds in order to prevent fogs or to stabilize photographic properties during production, storage or photographic processing thereof. Examples of anti-fogging agents or stabilizers usable for the above purpose include azoles, such as benzothiazoliums, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (in particular, 1-phenyl-5-mercaptotetrazole); mercaptopyrimidines; mercaptotriazines; thioketo compounds, such as oxazolinethiones; azaindenes, such as triazaindenes, tetraazaindenes (in particular, 4-hydroxy-substituted-(1,3,3a,7)tetraazaindenes) and pentaazaindenes; benzenethiosulfonic acids; benzenesulfinic acids; amides of benzenesulfonic acids; and the like.

Photographic emulsion layers and other hydrophilic colloid layers in the light-sensitive materials according to the present invention may be incorporated with various surface active agents in order to improve coating, antistatic, antislippage, emulsifying or dispersing, antiadhesion and other properties, as well as to enhance developability, contrast and sensitivity. Examples of surface active agents usable for such purposes include nonionic surfactants, such as steroids (e.g., saponin), alkylene oxide derivatives (e.g., polyethylene glycols, condensation products of polyethylene glycols and polypropylene glycols, polyethylene glycol alkyl ethers, polyethylene glycol alkylaryl ethers, polyethylene glycol esters, polyethylene glycol sorbitan esters, polyalkylene glycol alkylamines or alkylamides, addition products of silicons and polyethylene oxides, etc.), glycidol derivatives (e.g., alkenylsuccinic acid polyglycerides, alkylphenol polyglycerides, etc.), fatty acid esters of polyhydric alcohols, alkyl esters of saccharoses, etc.; anionic surfactants, such as alkylcarboxylates, alkylsulfonates, alkylbenzenesulfonates, alkylnaphthalenesulfonates, esters of alkylsulfuric acids, esters of alkylphosphoric acids, N-acyl-N-alkyltaurines, sulfosuccinic esters, sulfoalkyl polyoxyethylenealkylphenyl ethers, and polyoxyethylene alkylphosphoric esters; amphoteric surfactants, such as amino acids, aminoalkylsulfonic acids, aminoalkylsulfonic or aminoalkylphosphoric esters, alkylbetaines and amine oxides; and cationic surfactants, such as salts of alkylamines, heterocyclic quaternary ammonium salts (e.g., pyridiniums, imidazoliums, etc.) and fatty or heterocyclic ring-containing phosphonium or sulfonium salts.

Photographic emulsions used in the photographic light-sensitive materials according to the present invention may be spectrally sensitized by methine or other sensitizing dyes. Sensitizing dyes can be used either individually or in combination. Combinations of sensitizing dyes are often used for the purpose of supersensitization. The emulsions may be incorporated, in addition to a sensitizing dye, with a dye which per se exhibits no sensitizing effects or with a substance which absorbs substantially no visible lights, so as to attain supersensitizing effects. Examples of useful sensitizing dyes, combinations of supersensitizing dyes and colorless substances capable of exhibiting supersensitizing effects are described in *Research Disclosure,* Vol. 176, Item 17643, p. 23, Section IV-J (Dec., 1978).

In the photographic light-sensitive material of the present invention, photographic emulsion layers and other hydrophilic colloid layers may be incorporated with inorganic or organic hardeners. Examples of usable hardeners include chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoins, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), and the like. These hardeners may be used either alone or in combination.

In the photographic light-sensitive material of the present invention, photographic emulsion layers and other hydrophilic colloid layers may be incorporated with water-insoluble or sparingly soluble synthetic polymer dispersions, in order to improve dimensional stabilities and other characteristics. For this purpose, there may be used homo- or copolymers of alkyl acrylates or methacrylates, alkoxyalkyl acrylates or methacrylates, glycidyl acrylates or methacrylates, acrylamides or methacrylamides, vinyl esters (e.g., vinyl acetate), acrylonitrile, olefins, styrene, etc.; as well as copolymers of these monomers with such monomers as acrylic acid, methacrylic acid, $\alpha,\beta$-unsaturated dicarboxylic acids, hydroxyalkyl acrylates or methacrylates, sulfoalkyl acrylates or methacrylates and styrenesulfonic acid.

Photographic emulsion layers in the photographic light-sensitive material of the present invention may be incorporated with a color-forming coupler, or a compound capable of forming color through oxidative coupling with aromatic primary amine developers (e.g., phenylenediamine derivatives, aminophenol derivatives, etc.). Examples of useful magenta couplers include 5-pyrazolones, pyrazolobenzimidazoles, cyanoacetylcoumarones, open chain acylacetonitriles, and the like. Examples of useful yellow couplers include acylacetamides (e.g., benzoylacetanilides, pivaloylacetanilides, etc.), and the like. Examples of useful cyan couplers include naphthols and phenols. Couplers containing a hydrophobic group, or a so-called "ballast group" can be advantageous. Both 2- and 4-equivalent couplers are usable. Colored couplers having color correction effects, as well as so-called DIR couplers capable of releasing development inhibitors during the course of development, may be used, as well. There may also be used colorless couplers capable of forming cololess products and releasing development inhibitors.

The photographic light-sensitive material according to the present invention may be additionally incorporated with known anti-discoloring agents or color image stabilizers, including hydroquinone derivatives, gallic acid derivatives, p-alkoxyphenols, p-oxyphenols and bisphenols. Such compounds may be used individually, or two or more of such compounds may be used in combination.

Hydrophilic colloid layers in the photographic light-sensitive material of the present invention may be incorporated with UV absorbers. Examples of usable UV absorbers include benzotriazoles substituted with aryl groups, benzophenones, esters of cinnamic acid, butadiene compounds, benzoxazoles and polymers capable of absorbing UV rays. UV absorbers may be fixed in hydrophilic colloid layers contained in the light-sensitive material according to the invention.

Hydrophilic colloid layers in the photographic light-sensitive material of the present invention may be additionally incorporated with water-soluble dyes, in order to prevent irradiation or for other purposes. Examples of useful water-soluble dyes include oxonol dyes, hemioxonol dyes, styryl dyes, merocyanine dyes, cyanine dyes and azo dyes. Of these dyes, oxonols, hemioxonols and merocyanines can be particularly useful.

The photographic light-sensitive material of the present invention may be additionally incorporated with hydroquinone derivatives, aminophenol derivatives, gallic acid derivatives, ascorbic acid derivatives, etc., as an additive for preventing color fogs.

The present invention can be applied to multilayer multicolor photographic materials comprising a support having thereon at least two light-sensitive layers having different spectral sensitivities. In general, multilayer natural color photographic materials are provided with a support having thereon at least one red-sensitive emulsion layer, at least one green-sensitive emulsion layer and at least one blue-sensitive emulsion layer. The order of these emulsion layers may be selected arbitrarily. In ordinary cases, a cyan color-forming coupler is contained in a red-sensitive emulsion layer, a magenta color-forming coupler in a green-sensitive emulsion layer, and a yellow color-forming coupler in a blue-sensitive emulsion layer. If desired, different combinations of couplers and emulsions may be adopted.

Upon the production of photographic light-sensitive material according to the present invention, photographic emulsion layers and other hydrophilic colloid layers can be coated by any known coating method, including dip coating, roller coating, curtain coating and extruding coating methods. Coating methods described in U.S. Pat. Nos. 2,681,294, 2,761,791 and 3,526,528 can be advantageous.

As a support, there may preferably be used films of cellulose esters such as cellulose triacetate, films of polyesters such as polyethylene terephthalate, papers coated with $\alpha$-olefin polymers, and the like.

For the photographic processing of the light-sensitive material according to the present invention, there may be adopted any known processing process or processing solution, including, e.g., processing for forming silver images (black-and-white photographic processings) and photographic processings for forming dye images (color photographic processings). In general, such processings are carried out at a temperature between 18° C. and 50° C. If desired, processings may be carried out at a temperature higher than 50° C. or lower than 18° C.

Developing solutions to be used for black-and-white photographic processings may contain known developing agents, such as dihydroxybenzenes (e.g., hydroquinone), 3-pyrazolidones (e.g., 1-phenyl-3-pyrazolidone), aminophenols (e.g., N-methyl-p-aminophenol), or the like. These developing agents may be used individually, or two or more of these may be used simultaneously. In general, developing solutions may additionally contain such chemicals as preservatives, alkaline agents, pH buffers and anti-fogging agents. If necessary, developing solutions may be incorporated, in addition to the above additives, with dissolving aids, toning agents, developing accelerators, surface active agents, anti-foaming agents, water softeners, hardeners, thickeners, and the like.

Fixing solutions having an ordinary composition can be used for the fixing of the photographic light-sensitive material according to the present invention. As a fixing agent, there may be used thiosulfates or thiocyanates. Other known organic sulfur compounds having fixing capabilities may also be used. Fixing solutions may contain water-soluble aluminum salts as a hardener.

Dye images may be formed from the photographic light-sensitive material according to the present invention in accordance with conventional processes, including, for example, negative-positive processes described, e.g., in *Journal of the Society of Motion Picture and Television Engineering*, Vol. 61, pp. 667–701 (1953); color reversal processes wherein development is first effected in a developing solution containing a black-and-white developing agent to form a negative silver image which is then subjected to at least one uniform exposure or to at least one appropriate fogging treatment, followed by color development to form a positive dye image; and silver dye bleach processes wherein a photographic emulsion layer containing dyes is exposed imagewise and then developed to form a silver image, and the silver grains contained therein is used as a catalyst for bleaching dyes contained in the emulsion layer in an imagewise manner.

A color developing solution is generally composed of an aqueous alkaline solution containing a color developing agent. Any known primary aromatic amine developers can be used for the development of the photographic light-sensitive material according to the present invention. Examples of usable color developing agents include phenylenediamines, such as 4-amino-N,N-diethylaniline, 3-methyl-4-amino-N,N-diethylaniline, 4-amino-N-ethyl-N-$\beta$-hydroxylethylaniline, 3-methyl-4-amino-N-ethyl-N-$\beta$-hydroxylethylaniline, 3-methyl-4-amino-N-ethyl-N-$\beta$-methanesulfonamidoethylaniline and 4-amino-3-methyl-N-ethyl-N-$\beta$-methoxyethylaniline. It is also possible to use those color developing agents described by F. A. Mason, *Photographic Processing Chemistry*, pp. 226–229, Focal Press (1966), U.S. Pat.

Nos. 2,193,015 and 2,592,364, and Japanese Patent Application (OPI) No. 64933/73.

Color developing solutions may be incorporated with pH buffers, development inhibitors and anti-fogging agents. If necessary, the solutions may be additionally incorporated with water softeners, preservatives, organic solvents, development accelerators, color-forming couplers, competitive couplers, fogging agents, auxiliary developing agents, thickeners, polycarboxylic acid chelates, antioxidants, etc.

After color development, photographic emulsion layers are ordinarily subjected to bleaching treatment. Bleaching treatment may be conducted either independently or concurrently with fixing treatment. Examples of usable bleaching agents include salts of such polyvalent metals as iron (III), cobalt (IV), chromium (VI) and copper (II), peroxides, quinones, nitroso compounds, and the like. Bleaching and bleach-fixing solutions may be additionally incorporated with various additives, including bleaching accelerators, such as those described, e.g., in U.S. Pat. Nos. 3,042,520 and 3,241,966 and Japanese Patent Publication Nos. 8506/70 and 8836/70; and thiol compounds, such as those described in Japanese Patent Application (OPI) No. 65732/78.

The present invention will further be illustrated by examples.

EXAMPLE 1

(1) Preparation of Tabular Silver Bromide Grains for Comparison: (Sample I in Table 1)

To a vessel containing 1 liter of water were added 30 g of gelatin, 10.3 g of potassium bromide and 20 ml of aqueous 0.5 wt % solution of thioether, $HO(CH_2)_2S(CH_2)_2S(CH_2)_2OH$. To the resulting mixture were simultaneously added Solutions I and II set forth below over a period of 10 seconds and then Solutions III and IV by double jet method over a period of 65 minutes, whereby the mixture was maintained at a pAg of 9.0 and a pH of 6.5 with stirring and the temperature of the vessel at 73° C.

| | Solution | | | |
|---|---|---|---|---|
| | I | II | III | IV |
| $AgNO_3$ (g) | 4.5 | — | 95.5 | — |
| $H_2O$ (ml) | 17 | 16.7 | 561 | 542 |
| KBr (g) | — | 3.15 | — | 69.6 |
| Aqueous 5 wt % solution of $HO(CH_2)_2S(CH_2)_2S(CH_2)_2OH$ (ml) | — | 0.45 | — | 9.6 |

The thus obtained tabular silver halide grains had an average diameter (or average diameter of projected areas) of 1.7 μm and an average diameter/thickness ratio of 10.0.

The silver halide orains were chemically sensitized with chloroaurate and sodium thiocyanate and then incorporated with a coating aid and an anti-fogging agent, whereby the intensity of said chemical sensitization was so adjusted that a fog density of 0.02 would be obtained if the grains are applied at a coverage of 3 g/m$^2$.

(2) Preparation of Tabular Silver Iodobromide Grains for Comparison: (Sample II-1 in Table 1)

Silver halide grains were prepared in a similar manner as in Preparation (1) described hereinabove, except that 0.066 g of KI was additionally added to Solution II and 1.4 g of KI to Solution IV.

The thus obtained silver iodobromide grains contained 1.5 mol % of silver iodides, and had an average diameter of 1.81 μm and an average diameter/thickness ratio of 9.8.

(3) Preparation of Tabular Silver Bromide Grains for Comparison: (Sample II-2 in Table 1)

Silver halide grains were prepared in a similar manner as Preparation (1) described above, except that 0.088 g of KI was additionally added to Solution II and 1.865 g of KI to Solution IV.

The thus obtained silver halide grains had an average diameter of 1.90 μm and an average diameter/thickness ratio of 9.9. The grains were chemically sensitized and then incorporated with a coating aid and an anti-fogging agent in a similar manner as in Preparation (1) described above, whereby.the intensity of the chemical sensitization was so adjusted that the grains would generate fogs in the same level as that of Sample I prepared in Preparation (1).

(4) Preparation of Tabular Silver Iodobromide Grains for Comparison: (Sample III-1 in Table 1)

To a vessel containing 1 liter of water were added 30 g of gelatin, 77 g of potassium bromide, 1.465 g of potassium iodide and 20 ml of aqueous 0.5 wt % solution of thioether, $HO(CH_2)_2S(CH_2)_2S(CH_2)_2OH$. To this mixture was added with stirring Solution V set forth below over a period of 60 minutes at a temperature of 70° C.

The thus obtained flat silver halide grains had an average diameter of 1.85 μm and an average diameter/thickness ratio of 5.1. The grains were chemically sensitized with chloroaurate and sodium thiosulfate and incorporated with a coating aid and an anti-fogging agent, whereby the intensity of the chemical sensitization was so adjusted that a fog density of 0.02 would be obtained if the grains are used at a coverage of 3 g/m$^2$.

| | Solution V |
|---|---|
| $AgNO_3$ (g) | 100 |
| $H_2O$ (ml) | 600 |

(5) Preparation of Tabular Silver Iodobromide Grains for Comparison: (Sample III-2 in Table 1)

Silver halide grains were prepared in a similar manner as in Preparation (4), except that 1.953 g of potassium iodide was used in 1 liter of water.

Tabular silver bromide grains obtained had an average diameter of 1.97 μm and an average diameter/thickness ratio of 5.2. The grains were then subjected to the same treatment as in Preparation (4).

(6) Preparation of Tabular Grains Having Iodine Distribution According to the Invention: (Sample IV-1 in Table 1)

Silver halide grains were prepared in a similar manner as in Preparation (1), except that Solution VI set forth below was additionally added by triple jet method during the course of the addition of Solutions III and IV, whereby said addition of Solution VI was commenced 5 minutes after the beginning of the addition of Solutions III and IV (or at the time when a total of 11.846 g of $AgNO_3$ had been added from Solutions I and III) and continued for 10 minutes. During the addition of Solution VI, 14.7 g of $AgNO_3$ was introduced from Solution III into the reaction mixture contained in the vessel.

The addition of Solutions III and IV was continued during and after the addition of Solution VI, and completed in 65 minutes as in Preparation (1).

The thus prepared tabular silver halide grains had an average diameter of 1.83 μm and an average diameter/thickness ratio of 10.7. The grains were then subjected to the same chemical sensitization and other treatments.

| | Solution VI |
|---|---|
| KI (g) | 1.465 |
| $H_2O$ (ml) | 100 |

(7) Preparation of Tabular Grains According to the Invention: (Sample IV-2 in Table 1)

Silver halide grains were prepared in a similar manner as in Preparation (6), except that Solution VII set forth below was used instead of Solution VI.

Grains having an average diameter of 1.85 μm and an average diameter/thickness ratio of 10.8 were obtained.

| | Solution VII |
|---|---|
| KI (g) | 1.953 |
| $H_2O$ (ml) | 100 |

(8) Preparation of Tabular Grains According to the Invention: (Sample IV-3 in Table 1)

Silver halide grains were prepared in a similar manner as in Preparation (6), except that Solution VIII set forth below was used instead of Solution VI. The thus prepared grains had an average diameter of 1.90 μm and an average diameter/thickness ratio of 10.9. The grains were then subjected to the same treatment.

| | Solution VIII |
|---|---|
| KI (g) | 3.418 |
| $H_2O$ (ml) | 100 |

(9) Preparation of Tabular Grains According to the Invention: (Sample IV-4 in Table 1)

Silver halide grains were prepared in a similar manner as in Preparation (6), except that the addition of Solution VI was started at the beginning of addition of Solutions III and IV, and continued for a period of 10 minutes. The thus obtained grains were subjected to the same treatment.

Silver halide grains obtained had an average diameter of 1.85 μm and an average diameter/thickness ratio of 10.8.

(10) Preparation of Tabular Grains According to the Invention: (Sample IV-5 in Table 1)

Silver halide grains were prepared in a similar manner as in Preparation (6), except that Solution IX set forth below was used instead of Solution VI and that the addition of Solution IX was commenced 15 minutes after the beginning of the addition of Solutions III and IV (that is, at the time when a total of 26.54 g of $AgNO_3$ had been introduced therein from Solutions I and III) and continued for a period of 10 minutes. The thus obtained grains had an average diameter of 1.81 μm and an average diameter/thickness ratio of 10.5. The grains were then subjected to the same treatment.

| | Solution IX |
|---|---|
| KI (g) | 4.882 |
| $H_2O$ (ml) | 100 |

(11) Preparation of Coated Samples

Each sample prepared hereinabove was coated on one surface of a subbed polyethylene terephthalate film having a thickness of 180 μm at a coverage of silver of 2.5 g/m$^2$. A protective surface layer was simultaneously formed upon the silver halide emulsion layer.

For this protective layer was used an aqueous 10% gelatin solution consisting of gelatin, sodium polystyrenesulfonate, fine particles of polymethyl methacrylate (average particle size: 30μ), saponin and 2,4-dichloro-6-hydroxy-s-triazine.

(12) Evaluation of Pressure Characteristics (a) Samples I to IV-5 coated on the film support were subjected to exposure under a condition of 40% relative humidity.

(b) Samples I to IV-5 were bent at an angle of 180° at a bending rate of 360° per second along the surface of a stainless steel pipe having a diameter of 10 mm, one end of said sample being fixed during the bending operation. Each sample was exposed 10 seconds after said bending operation.

The resulting samples were subjected to Processing A set forth below, and then fixed, washed and dried. Sensitivities of the bent areas, relative to the sensitivities of corresponding areas in the samples according to [a) described above, were calculated. Results obtained are shown as ΔLog E in Table 1, whereby sensitivities of the samples were calculated as the reciprocal of amount of exposure necessary to obtain a density of +0.3 above fog density.

(c) Samples I to IV-5 were bent along the surface of a stainless steel pipe in a similar manner, as in (b), and then subjected to Processing A 30 seconds after the bending operation. The samples were fixed and dried. Increase in fog caused by the bending operation was determined through correction with maximum densities of samples treated in accordance with (a) described above. Results obtained are shown as ΔFog/Dmax in Table 1.

When treated in accordance with (b) above, only Samples III-1 and III-2 showed marked desensitization. Other samples showed substantially no changes in their photographic properties. No pressure fogs were generated by the bending along the surface of pipe having a diameter of 10 mm.

Upon the above-described treatment (c), only Samples III-1 and III-2 showed no pressure fogs.

Processing A

Samples were developed at a temperature of 35° C. for a period of 25 seconds in a developing solution having the following composition:

| | |
|---|---|
| 1-Phenyl-3-pyrazolidone | 1.3 g |
| Hydroquinone | 30.0 g |
| 5-Nitroindazole | 0.25 g |
| KBr | 3.7 g |
| Anhydrous sodium sulfite | 50.0 g |
| Potassium hydroxide | 20.0 g |
| Boric acid | 10.0 g |
| Aqueous 25% glutaraldehyde | 20.0 ml |
| Water to make | 1 l |
| (pH is adjusted to 10.20) | |

(13) Evaluation of Results

Sensitivities of Samples III-1 and III-2, upon the preparation of which potassium iodide was added to the solution contained in the reaction vessel, experience decreases as much as 40% when subjected to pressure before being exposed. Samples I, II-1 and II-2, which have a uniform silver halide composition throughout the grains, are free from desensitization caused by pressure. However, they suffer from significant increases in fogs. On the contrary, in Samples IV-1 to IV-5 according to the present invention, generation of fogs owing to pressure can be prevented without causing pressure desensitizations.

It would be understood from the comparison of characteristics shown in Table 1 that pressure fogs can be markedly inhibited by the increase in iodine content in AgBrI area (or internal high iodine phase) of silver halide grains. It would also be seen that silver halide grains having an AgBrI area at positions nearer to the center of grains can be more preferable in cases where the compositions of AgBrI areas are identical, as seen in Samples IV-1 and IV-4. Considerable pressure desensitization is experienced in the case where an AgBrI area is present at the central part of flat grains, as is seen in Samples III-1 and III-2.

TABLE 1

| Sample No. | Pressure Characteristics ΔLog E | (a-c) ΔFog/Dmax | Iodine Content in Emulsion (mol %) | Distribution of Iodine within Grain |
|---|---|---|---|---|
| Sample I | 0 | 0.072 | 0 | AgBr |
| Sample II-1 | 0 | 0.070 | 1.5 | Uniform AgBrI |
| Sample II-2 | 0 | 0.069 | 2.0 | Uniform AgBrI |
| Sample III-1 | −0.27 | 0 | 1.5 | KI was charged into a vessel to which $AgNO_3$ was added. |
| Sample III-2 | −0.25 | 0 | 2.0 | KI was charged into a vesssel to which $AgNO_3$ was added. |
| Sample IV-1* | 0 | 0.056 | 1.5 | AgBr**/AgBrI(mol % of I)/AgBr*** = 11.85/14.7(10.2)/73.45 (mol %) |
| Sample IV-2* | 0 | 0.028 | 2.0 | 11.85/14.7(13.6)/73.45 |
| Sample IV-3* | 0 | 0.015 | 3.5 | 11.85/14.7(23.8)/73.45 |
| Sample IV-4* | 0 | 0.041 | 1.5 | 4.5/14.7(10.2)/80.8 |
| Sample IV-5* | 0 | 0.035 | 5.0 | 26.54/14.7(33.2)/58.76 |

Notes:
*Sample according to the invention
**Central phase of grain
***Outermost phase of grain

EXAMPLE 2

(1) Preparation of Silver Iodobromide Plates for Comparison: (Sample V in Table 2)

Silver halide grains were prepared in a similar manner as in Preparation (1) in Example 1, except that 0.11 g of KI was used in Solution II and 2.33 g of KI in Solution IV. The thus obtained silver halide grains had an average diameter of 1.93 μm and an average diameter/thickness ratio of 10.1. The grains were then treated in the same manner as in Preparation (1) in Example 1.

(2) Preparation of Silver Iodobromide Plates According to the Invention: (Sample VI-1 in Table 2)

Silver halide grains were prepared in a similar manner as in Preparation (6) in Example 1, except that $4.39\times10^{-3}$ g of KI was used in Solution II and 0.0933 g of KI in Solution IV. The thus obtained grains had an average diameter of 1.83 μm and an average diameter/thickness ratio of 10.7. The grains were then subjected to the same treatment.

(3) Preparation of Silver Iodobromide Plates According to the Invention: (Sample VI-2 in Table 2)

Silver halide grains were prepared in a similar manner as in Preparation (6) in Example 1, except that 0.022 g of KI was used in Solution II and 0.466 g of KI in Solution IV. The thus obtained grains had an average diameter of 1.85 μm and an average diameter/thickness ratio of 10.9. The grains were then subjected to the same treatment.

(4) Preparation of Silver Iodobromide Plates According to the Invention: (Sample VI-3 in Table 2)

Silver halide grains were prepared in a similar manner as in Preparation (6) in Example 1, except that 0.044 g of KI was used in Solution II and 0.933 g of KI in Solution IV. The thus obtained grains had an average diameter of 1.91 μm and an average diameter/thickness ratio of 11.0. The grains were then subjected to the same treatment.

The emulsions obtained hereinabove were coated and tested in the same manner as in Example 1. Results obtained are shown in Table 2.

Comparing Samples VI-1, VI-2 and VI-3, the iodine content in the internal high iodine phase in silver halide grains of Sample VI-1 is 69 times that of the low iodine phases, and this ratio is 14.6 in the case of Sample VI-2 and 7.8 in Sample VI-3. It would, therefore, be understood that increase in this ratio results in decrease in the pressure fog. It would also be seen from the table that pressure fogs formed in samples according to the present invention are smaller than that of Sample V used for the purpose of control.

TABLE 2

| Sample No. | Pressure Characteristics ΔLog E | ΔFog/Dmax | Iodine Content in Emulsion (mol %) | Distribution of Iodine within Grain |
|---|---|---|---|---|
| Sample IV-2 | 0 | 0.056 | 1.5 | AgBr/AgBrI(mol % of I)AgBr = 11.85/14.7(6.8)/73.45 |
| Sample V | 0 | 0.068 | 2.5 | Uniform AgBrI (I: 2.5 mol %) |
| Sample VI-1 | 0 | 0.058 | 1.6 | AgBrI(mol % of I)/AgBrI(mol % of I)/AgBrI(mol % of I) = 11.85(0.1)/14.7(6.9)/73.45(0.1) |
| Sample VI-2 | 0 | 0.061 | 2.0 | 11.85(0.5)/14.7(7.3)/73.45(0.5) |
| Sample VI-3 | 0 | 0.064 | 2.5 | 11.85(1.0)/14.7(7.8)/73.45(1.0) |

EXAMPLE 3

(1) Preparation of Silver Iodobromide Grains by Conversion: (Sample VII-1 in Table 3)

Silver halide grains were prepared in a similar manner as in Preparation (1) in Example 1, except that the addition of Solutions III and IV was continued for 20 minutes (or until a total of 34 mol % of silver nitrate had been added thereto from Solutions I and III), suspended for 5 minutes and then resumed, and that 9.76 ml of 1% KI solution was added just after the suspension of the addition of Solutions III and IV. The thus obtained grains had an average diameter of 1.71 μm and an average diameter/thickness ratio of 10.0. Thereafter, the grains were treated in the same manner as in Preparation (1) in Example 1.

(2) Preoaration of Silver Iodobromide Grains by Conversion: (Sample VII-2 in Table 3)

Silver halide grains were prepared in a similar manner as in Preparation (1) described above, except that 23.9 ml of 1% KI solution was used instead of 9.76 ml of 1% KI solution. The thus obtained silver halide grains had an average diameter of 1.71 μm and an average diameter/thickness ratio of 10.1. The grains were then treated in the same manner.

(3) Preparation of Silver Iodobromide Grains by Conversion: (Sample VII-3 in Table 3)

Silver halide grains were prepared in a similar manner as in Preparation (1) described above, except that 4.88 ml of 10% KI solution was used instead of 9.76 ml of 1% KI solution. The thus obtained silver halide grains had an average diameter of 1.73 μm and an average diameter/thickness ratio of 10.1. The grains were then subjected to the same treatment.

(4) Preparation of Silver Iodobromide Grains by Conversion: (Sample VII-4 in Table 3)

Silver halide grains were prepared in a similar manner as in Preparation (2) described above, except that the addition of 1% KI solution was commenced after the addition of Solutions III and IV had been continued for 30 minutes 17 seconds (or at the time when a total of 49 mol % of silver halide had been added thereto). The thus prepared silver halide grains had an average diameter of 1.76 μm and an average diameter/thickness ratio of 10.1. The grains were then subjected to the same treatment.

The photographic emulsions prepared as described above were coated and tested in the same manner as in Example 1. Results obtained are shown in Table 3.

As is apparent from Table 3, photographic light-sensitive materials having improved pressure characteristics can be obtained by providing tabular silver halide grains with an internal high iodine phase by means of conversion.

TABLE 3

| Sample No. | Pressure Characteristics ΔLog E | ΔFog/Dmax | Position of Conversion Internal Ag/Ag (mol %) | Amount of KI Used for Conversion (mol %) |
|---|---|---|---|---|
| Sample I | 0 | 0.072 | 0 | 1 |
| Sample VII-1 | 0 | 0.066 | 34/66 | 0.1 |
| Sample VII-2 | 0 | 0.054 | 34/66 | 0.3 |
| Sample VII-3 | −0 | 0.029 | 34/66 | 0.5 |
| Sample VII-4 | −0 | 0.058 | 49/51 | 0.3 |

EXAMPLE 4

(1) Preparation of Sample VIII-1 in Table 4

To a vessel containinq 1 liter of water were added 30 g of gelatin, 10.3 g of gelatin, 10.3 g of potassium bromide and 20 ml of aqueous 0.5 wt % solution of thioether, $HO(CH_2)_2S(CH_2)_2S(CH_2)_2OH$. To the resulting mixture were simultaneously added with stirring Solutions I and II set forth below over a period of 10 seconds. Subsequently, Solutions III and IV set forth below were added thereto by the double jet method over a period of 24 minutes, and then Solutions V and VI set forth below by the double jet method over a period of 41 minutes. During the addition of Solutions I to VI, the temperature of the reaction vessel was maintained at 73° C.

The thus obtained grains had an average diameter of 1.83 μm and an average diameter/thickness ratio of 10.7. The grains were then treated in the same manner as in Preparation (1) in Example 1.

| | Solution I | II | III | IV | V | VI |
|---|---|---|---|---|---|---|
| $AgNO_3$ (g) | 4.5 | — | 35.5 | — | 60 | — |
| $H_2O$ (ml) | 17 | 16.7 | 208.5 | 201 | 352 | 340 |
| KBr (g) | — | 3.15 | — | 25.9 | — | 43.7 |
| KI (g) | — | 0.165 | — | 1.30 | — | — |
| Aqueous Thioether Solution (5 wt %) | — | 0.45 | — | 3.57 | — | 6.03 |

(2) Preparation of Sample VIII-2 in Table 4

Silver halide grains were prepared in a similar manner as in Preparation (1) described above, except that Solutions A and B set forth below were added instead of Solutions I and II over a period of 10 seconds, Solutions C and D instead of Solutions III and IV over a period of 17 minutes by the double jet method, and then Solutions E and F instead of Solutions V and VI over a period of minutes by the double jet method. The thus obtained grains had an average diameter of 1.85 μm and an average diameter/thickness ratio of 11.0. The grains were then subjected to the same treatment.

| | Solution | | | | | |
|---|---|---|---|---|---|---|
| | A | B | C | D | E | F |
| $AgNO_3$ (g) | 4.5 | — | 25.5 | — | 70 | — |
| $H_2O$ (ml) | 17 | 16.7 | 150 | 144.7 | 411 | 397 |
| KBr (g) | — | 3.15 | — | 18.6 | — | 51.0 |
| KI (g) | — | 0.220 | — | 1.245 | — | — |
| Aqueous Thioether Solution (5 wt %) | — | 0.45 | — | 2.56 | — | 7.04 |

The emulsions obtained above were coated and tested in the same manner as in Example 1. Results obtained are shown in Table 4. It can be understood from the table that photographic materials according to the present invention have improved pressure characteristics.

TABLE 4

| Sample No. | Pressure Characteristics ΔLog E | ΔFog/Dmax | Iodine Content in Emulsion (mol %) | Distribution of Iodine within Grain |
|---|---|---|---|---|
| Sample II-1 | 0 | 0.070 | 1.5 | Uniform AgBrI |
| Sample VIII-1 | 0 | 0.058 | 1.5 | 40(3.75)/60 |
| Sample VIII-2 | 0 | 0.043 | 1.5 | 30(5.0)/70 |

EXAMPLE 5

(1) Preparation of Tabular Grains Accordinq to the Invention

To 1.3 liter of water contained in a reaction vessel were added 30 g of gelatin, 7 g of potassium bromide, 4 g of potassium iodide and 3 ml of 50% acetic acid. To the resulting mixture were added with stirring Solutions I and II set forth below over a period of 18 minutes, whereby the temperature of the vessel was maintained at 65° C. Subsequently, 9 ml of aqueous 25% ammonia was added thereto and stirred for an additional 25 minutes.

| | Solution I | Solution II |
|---|---|---|
| $AgNO_3$ (g) | 100 | — |
| KBr (g) | — | 70 |
| $H_2O$ (ml) | 700 | 700 |

The resulting mixture was divided into 1/20 portions, and one portion of the mixture was placed to a vessel containing a mixture of 1 liter of water, 30 g of gelatin and 0.25 g of potassium bromide and maintained at a temperature of 65° C. To this were additionally added Solution III set forth below and an aqueous potassium bromide solution by the controlled double jet method over a period of 120 minutes, while maintaining its potential at −30 mV. The thus formed grains were then subjected to chemical ripening and other treatments in the same manner as described hereinabove. Tabular grains obtained had an average diameter of 1.5 μm and an average diameter/thickness ratio of 6.8.

| | Solution III |
|---|---|
| $AgNO_3$ (g) | 145 |

-continued

| | Solution III |
|---|---|
| $H_2O$ (l) | 1.5 |

The emulsions prepared above were coated and tested in the same manner as in Example 1. Results shown in Table 5 were obtained. It would be understood that photographic light-sensitive materials according to the present invention have improved pressure characteristics.

TABLE 5

| Sample No. | Pressure Characteristics ΔLog E | ΔFog/Dmax |
|---|---|---|
| Sample IX | 0 | 0.038 |
| Sample I (control) | 0 | 0.072 |

Structures of tabular grains prepared in the above-described Examples can be confirmed by X-ray diffractiometry, EPMA (also referred to as XMA) and/or a high voltage electron microscope of the transmission type.

For example, Sample IV-1 prepared in Example 1 gave the following results.

(i) In X-ray analysis, a shoulder peak of AgBrI, overlapped with a peak of AgBr, was observed at a position corresponding to an iodine content of 10.1 mol %. This result is in agreement with the intended composition within limits of possible determination error.

(ii) Analysis of iodine distribution within flat grains by means of EPMA. method showed that an annular internal high iodine phase having a silver iodide content of 10 mol % is present in the internal part of pure silver bromide grains in conformity with the formulation.

(iii) An annular ring of silver iodobromide corresponding to the formulation was observed in the photograph of the tabular grains taken by a high voltage electron microscope of transmission type (see FIG. 1).

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one silver halide emulsion layer containing light-sensitive silver halide grains, at least 10% in number of said halide grains being tabular grains having a diameter/thickness ratio of not less than 5, and said tabular silver halide grains satisfying the following conditions:

(1) each tabular grain comprises an iodine-containing silver halide solid solution internal high iodine phase in the interior part thereof, and said internal high iodine phase is contained with areas covering, with regard to its major axis direction, 60% by mole of silver in the grain;

(2) the average iodine content in said internal high iodine phase is not less than the average iodine content of any phase in each grain and at least 5 times that of silver bromide, iodobromide or chloroiodobromide contained in any phase which is present outside of said internal high iodine phase; and (3) the amount of silver contained in said internal high iodine phase is not more than 50% by mole of the total amount of silver contained in the grain and wherein each said tabular grains has a total iodine content of from 0.1 to 10% by mole.

2. A silver halide photographic, light-sensitive material as claimed in claim 1, wherein said internal high iodine phase has an iodine content of 0.5 to 40% by mole.

3. A silver halide photographic light-sensitive material as claimed in claim 1, wherein iodine is distributed within said internal high iodine phase with a coefficient of variation not exceeding 40%.

4. A silver halide photographic light-sensitive material as claimed in claim 1, wherein the iodine content in said internal high iodine phase is at least 10 times, that of any phase outside thereof.

5. A silver halide photographic light-sensitive material as claimed in claim 1, wherein the iodine content in said internal high iodine phase is at least 20 times that of any phase outside thereof.

6. A silver halide photographic light-sensitive material as claimed in claim 1, wherein the phase which is present outside of said internal high iodine phase is composed of silver bromide.

7. A silver halide photographic light-sensitive material as claimed in claim 1, wherein the phase which is present outside of said internal high iodine phase is composed of silver iodobromide or chloroiodobromide in which iodine is distributed with a coefficient of variation not exceeding 40%.

8. A silver halide photographic, light-sensitive material as claimed in claim 1 wherein a silver bromide or iodobromide phase having low iodine content is present in the interior of said internal high iodine phase or in the central part of said grain.

9. A silver halide photographic light-sensitive material as claimed in claim 1, wherein said internal high iodine phase is formed by conversion.

10. A silver halide photographic light-sensitive material as claimed in claim 1, wherein said tabular grains have a diameter of from 0.5 to 10 μm.

11. A silver halide photographic light-sensitive material as claimed in claim 1, wherein said tabular grains have a diameter of from 0.5 to 5 μm.

12. A silver halide photographic,, light-sensitive material as claimed in claim 1, wherein said tabular grains have a diameter/thickness ratio of from 5 to 100.

13. A silver halide photographic light-sensitive material as claimed in claim 1, wherein said tabular grains have a diameter/thickness ratio of from 5 to 50.

14. A silver halide photographic light-sensitive material as claimed in claim 1, wherein said flat grains are coated at a coverage of 0.5 to 6 $g/m^2$.

15. A silver halide photographic light-sensitive material as claimed in claim 1, wherein said material comprises, in addition to said tabular grain-containing emulsion layer, a second silver halide emulsion layer, said tabular grain-containing-layer lying at a position nearer to the support than the second emulsion layer.

16. A silver halide photographic light-sensitive material as claimed in claim 15, wherein said second silver halide emulsion layer has a photosensitivity higher than said tabular grain-containing layer.

17. A silver halide photographic light-sensitive material as claimed in claim 1, wherein said support is coated with silver halide emulsion layers containing said tabular silver halide grains on both sides thereof.

18. A silver halide photographic light-sensitive material as claimed in claim 1, wherein the silver halide contained in the silver halide emulsion layer is silver iodobromide.

19. A silver halide photographic light-sensitive material as claimed in claim 2, wherein the silver halide contained in the silver halide emulsion is silver iodobromide.

20. A silver halide photographic light-sensitive material as claimed in claim 3, wherein the silver halide contained in the silver halide emulsion layer is silver iodobromide.

21. A silver halide photographic light-sensitive material as claimed in claim 4, wherein the silver halide contained in the silver halide emulsion layer is silver iodobromide.

22. A silver halide photographic light-sensitive material as claimed in claim 1, wherein the internal high iodine phase forms the core of the grain.

* * * * *